United States Patent [19]

Hara

[11] 4,286,248

[45] Aug. 25, 1981

[54] THERMAL CUT-OFF FUSE

[75] Inventor: Kunio Hara, Kawasaki, Japan

[73] Assignee: Nifco Inc., Kanagawa, Japan

[21] Appl. No.: 123,131

[22] Filed: Feb. 21, 1980

[30] Foreign Application Priority Data

Feb. 22, 1979 [JP] Japan ..... 54/19003

[51] Int. Cl.[3] ..... H01H 37/76

[52] U.S. Cl. ..... 337/403; 337/407

[58] Field of Search ..... 337/401, 402, 403, 407, 337/408, 409

[56] References Cited

U.S. PATENT DOCUMENTS

| | | | |
|---|---|---|---|
| 4,167,724 | 9/1979 | McCaughna | 337/407 |
| 4,184,139 | 1/1980 | Hara | 337/407 |

*Primary Examiner*—George Harris

*Attorney, Agent, or Firm*—Thomas W. Buckman; Glenn W. Bowen

[57] ABSTRACT

A thermal cut-off fuse for breaking electric continuity between two lead wires, which utilizes melting and voluminal expansion of a temperature-sensitive member in a sealed state at a prescribed temperature.

5 Claims, 6 Drawing Figures

THERMAL CUT-OFF FUSE

BACKGROUND OF THE INVENTION

This invention relates to a thermal cut-off fuse for breaking electric continuity between two lead wires at the time that the ambience of the fuse reaches a prescribed temperature, and more particularly to improvements in and relating to a thermal cut-off fuse using a temperature-sensitive member which melts at the prescribed temperature.

Many kinds of thermal cut-off fuses have heretofore been disclosed to the art. (U.S. Pat. Nos. 4068204, 4075595, 4075596, 4084147, 4127839, for example) As far as securing electric continuity between two lead wires under the normal working conditions below the prescribed temperature is concerned, those thermal cut-off fuses which use solid contacts are relatively safe and inexpensive. However, such conventional thermal cut-off fuses have required some kind of mechanical actuating means for dependably moving and isolating a contact means from at least one of the leads at the time the temperature-sensitive member reaches the prescribed temperature and melts. Generally, these actuating means incorporate at least spring means. The incorporation of such actuating means, therefore, has notably added to complication of the assemblage of smaller thermal cut-off fuses (those which are 3 to 5 mm in diameter and 7 to 10 mm in length, for example). Further from the operational point of view, variation in the charge imparted to the spring means has resulted, not infrequently, in mechanical failures. Moreover, the incorporation of these actuating means has the disadvantage that the total number of component parts involved are inevitably increased.

In the conventional thermal cut-off fuses using a temperature-sensitive member, the member melts upon reaching the prescribed temperature and the molten material flows into the gaps in the thermal cut-off fuse housings and, owing to its viscosity, locally retards the movements of the mechanical components so much as to impede normal functions of the fuses. As a result, even when the member melts at the prescribed temperature, the separation of the contacts of the fuse may occur only with some time lag. In the extreme cases, there is the possibility that the component parts of such fuses may fail to function normally to effect separation of the contacts as required.

Having issued from the realization of the state of affairs described above, the present invention has as one of its objects the provision of a thermal cut-off fuse which has a temperature-sensitive member and directly functions to effect separation of its contacts without use of a spring operated actuating means and which, therefore, functions safely over many years of service.

Another object of this invention is to provide a highly reliable thermal cut-off fuse which has a simple construction and uses a small number of component parts.

SUMMARY OF THE INVENTION

To accomplish the objects described above according to the present invention, there is provided a thermal cut-off fuse which comprises a housing, contact means contained within the housing and adapted to be movable from a first position to a second position, the contact means electrically contacting the terminal of a first lead wire and the terminal of a second lead wire at the first position and not contacting at least one of the terminals at the second position, and a temperature-sensitive member contained within a closed chamber defined by the housing and the contact means disposed at the first position, the temperature-sensitive member being increasing in volume when melted at the prescribed temperature. When the temperature of the ambience of the fuse reaches the melting point of the temperature-sensitive member, the temperature-sensitive member melts and expands in volume to move the contact means to the second position from the first position.

As described above, the contact means of the thermal cut-off fuse of the present invention is disposed inside the housing and is adapted to be moved from the first position to the second position by the voluminal expansion of the temperature-sensitive member. The thermal cut-off fuse, accordingly, enjoys the advantage that the number of component parts is small and that it provides the required breakage of electric continuity without fail.

The other objects and characteristics of the present invention will become apparent from the further disclosure of the invention to be made hereinafter with reference to the accompanying drawing.

DESCRIPTION OF PREFERRED EMBODIMENTS

Figure 1:
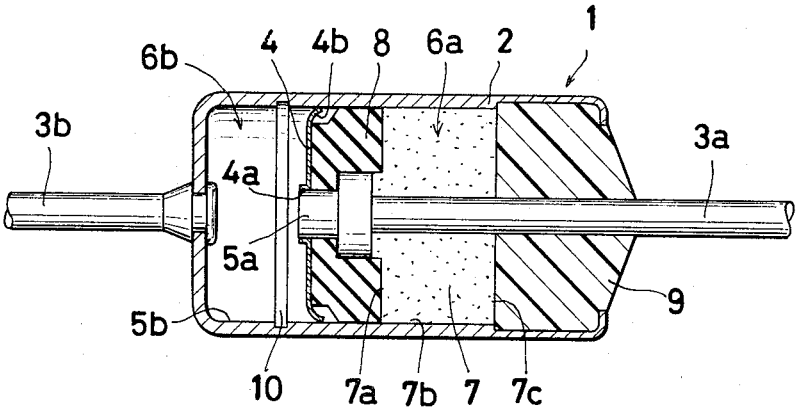
FIG. 1 is a sectioned view of a first embodiment of the thermal cut-off fuse according to the present invention.
Figure 2:
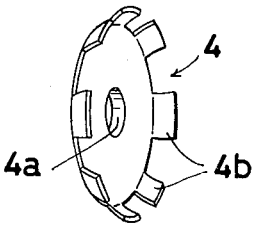
FIG. 2(A) is a perspective view of an embodiment of the contact means for use in the thermal cut-off fuse according to the present invention.
FIG. 2(B) is a side view of the contact means of FIG. 2(A).
Figure 2:
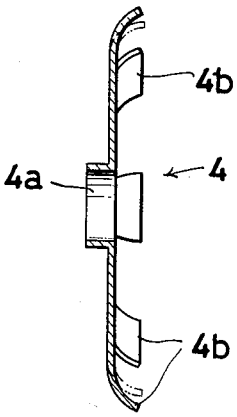
Figure 3:
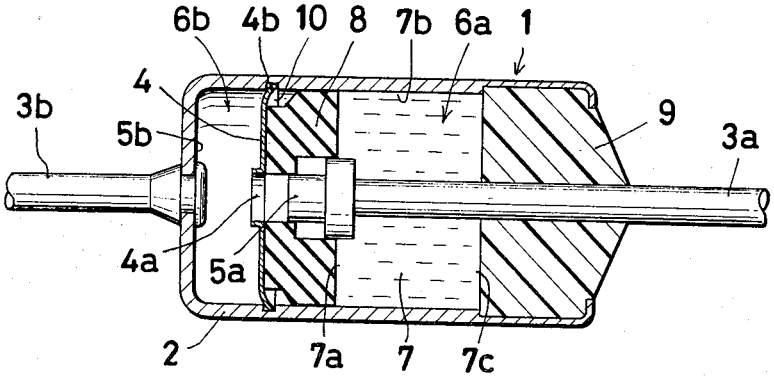
FIG. 3 is a sectioned view illustrating how the thermal cut-off fuse of FIG. 1 functions.

FIGS. 1–3 illustrate a first embodiment of the thermal cut-off fuse according to the present invention. The thermal cut-off fuse 1 of this embodiment is of the so-called tubular type or the horizontal or axial type having a pair of lead wires 3*a*, 3*b* extending out through the opposite ends of the housing 2.

The housing 2 has a hollow space within and contains within this hollow space electrically conductive contact means 4 adapted to be slidably movable from the first position shown in FIG. 1 to the second position shown in FIG. 3. The contact means 4 serves the purpose of establishing electric continuity between the two lead wires 3*a*, 3*b* at the first position and breaking the electric continuity at the second position. For this purpose, the two lead wires 3*a*, 3*b* possess terminal portions 5*a*, 5*b* respectively exposed in the hollow space of the housing. In the case of the present embodiment, one lead wire 3*a* enters the housing interior and the leading end thereof constitutes the terminal portion 5*a*, and the other lead wire 3*b* is fastened by caulking to the housing 2 which is made of an electrically conductive material so that the inner wall of the housing itself constitutes the terminal portion 5*b*.

Owing to this arrangement, when the contact means 4 is at the first position, it remains in contact with the terminal portion 5*a* at the end of the lead wire 3*a* and the inner wall 5*b* of the housing to maintain electric continuity between the two lead wires. When the contact means 4 moves to the second position, however, it still remains in contact with the inner wall 5*b* of the housing but is separated from the terminal portion 5*a* of the lead wire 3*a* and, therefore, breaks the electric continuity between the two lead wires.

One typical shape of the contact means 4 to be used in the present embodiment is as illustrated in FIG. 2(A), FIG. 2(B), for example. This contact means 4 is provided at the center thereof with a circular perforation 4*a* of a diameter such as to permit the terminal portion 5*a* of the lead wire 3*a* to be inserted therethrough with moderate pressure and further provided around the periphery thereof with a plurality of circumferentially spaced petal-like portions 4*b* rising so much as to come into contact with the inner wall 3*b* of the housing with moderate pressure. Thus, the contact means 4 has a general appearance of a chrysanthemum-shaped seat. The individual petal-like portions 4*b* are shaped so as to slant outwardly in the radial direction (as indicated by the solid line in FIG. 2(B). At the time that the contact means 4 is inserted into the hollow space of the housing, the leading ends of these petal-like portions are slightly bent inwardly in the radial direction (as indicated by the chain line in FIG. 2(B) and, after the insertion, the petal-like portions are pressed against the inner wall 5*b* of the housing by virtue of their own resilience.

In this case, since the housing 2 is cylindrical in shape, the contact means 4 is in the general shape of a disc. When the housing has some other cross-sectional shape such as a square, for example, the contact means 4 should, of course, possess the shape of a square in conformity with the square cross section of the housing interior.

In the course of the manufacture of the thermal cut-off fuse of this invention, the terminal portion 5*a* of the first lead wire 3*a* is inserted by the exertion of slight pressure into the perforation 4*a* at the center of the contact means 4 and the contact means, with the petal-like portions on the periphery thereof bent inwardly, is inserted to the position in the housing interior as illustrated in FIG. 1. This is the first position for the contact means 4. In the condition illustrated herein, the contact means 4 establishes electric continuity between the two lead wires 3*a*, 3*b*.

The hollow space within the housing is divided into the space 6*a* on the side of the first position 4 and the space 6*b* on the side of the second position respectively of the contact means. The space 6*a* on the side of the first position is filled with a temperature-sensitive member 7 well known to the art.

As the temperature-sensitive member 7 is in the form of an ordinary pellet at normal temperature, it can be compression molded or melt molded to match the shape of the space 6*a* in the housing. Once the temperature-sensitive member 7 is inserted into the space 6*a*, its peripheral surface 7*b* and rear surface 7*c* are surrounded by fixed walls and the only surface thereof not in contact with a fixed wall is the surface 7*a* facing the contact means 4.

To be specific, the peripheral surface 7*b* of the member is surrounded by the inner wall 5*b* of the housing and the rear surface 5*a* thereof is held back by a cover made of a synthetic resin, for example, and adapted to seal the opening of the housing through which the lead wire 3*a* is inserted after the internal component parts (such as the terminal portion 5*a*, the contact means 4, the member 7, and a bushing to be described afterward) have been incorporated in the housing.

Between the contact means 4 and the surface 7*a* of the member opposed to the contact means 4, there is interposed a bushing 8 made of rubber or some other suitable resin which remains in intimate contact with the inner wall 5*b* of the housing, possesses a perforation at the center for permitting passage therethrough of the lead wire 3*a* and serves to preclude escape of the member 7 when the member is melted at the prescribed temperature. Since the bushing 8 is not fastened to the shell of the housing, it is allowed to produce a sliding motion relative to the housing. When it is thus moved to the lefthand side with reference to the drawing, it can press the contact means 4 from the first position to the second position.

In one aspect, the idea underlying the present invention depends on a special physical property of temperature-sensitive members in general use. Specifically, many, if not all, kinds of members adapted for the purpose are characterized by undergoing discernible voluminal expansion (generally variable within the range of from 3 to 8%) at the time they change from the solid to the melted state.

In the thermal cut-off fuse of the construction described above, therefore, when such a member 7 is tightly sealed in the space 6*a* at the first position of the contact means 4, the thermal cut-off fuse fulfills its function advantageously by operating in the manner to be described below.

The state which the thermal cut-off fuse of the present embodiment assumes upon completion of its assembly or during the normal condition existing prior to the elevation of the ambience to the prescribed temperature has so far been described as illustrated in FIG. 1. While the thermal cut-off fuse remains in this normal state, a continued path for electric current is formed between the lead wire 3*a* and the lead wire 3*b* via the terminal portion 5*a*, the contact means 4 and the terminal portion 5*b* (the inner wall of the housing). Thus, the electric appliance incorporating this thermal cut-off fuse is allowed to operate normally.

When the temperature of the ambience of the thermal cut-off fuse reaches the prescribed temperature (melting point of the temperature-sensitive member) and the electric appliance must be protected by breaking its path of electric current, the member 7 quickly melts. Consequently, the member undergoes voluminal expansion, which occurs only in the direction of the free surface 7*a*. The force of this voluminal expansion is transformed into a force which presses the interposed bushing 8 to the lefthand side with reference to the drawing.

As the bushing is pressed as described above, the contact means 4 which is held in contact with the bushing is similarly pressed to the left and the terminal of the lead wire 3*a* entering into the housing interior is released from its pressed engagement with the central perforation 4*a* (FIG. 3). By thus breaking the electric continuity between the two terminals 5*a*, 5*b*, the thermal cut-off fuse discharges its primary object.

Since the temperature-sensitive member 7 is tightly sealed so that it is allowed to expand only in the direction of the surface 7*a* opposed to the contact means 4, a thermal cut-off fuse of a very simple construction using a small number of components parts can provide the required circuit breakage without fail. The surface 7*a* of the member which is moved when the member is melted and voluminally expanded is required to keep the molten member from leaking and entering the space 6*b* on the side of the second position of the contact means until the surface brings the contact means to the second position. The part which fulfils this requirement is the bushing 8 in the present embodiment.

Figure 4:
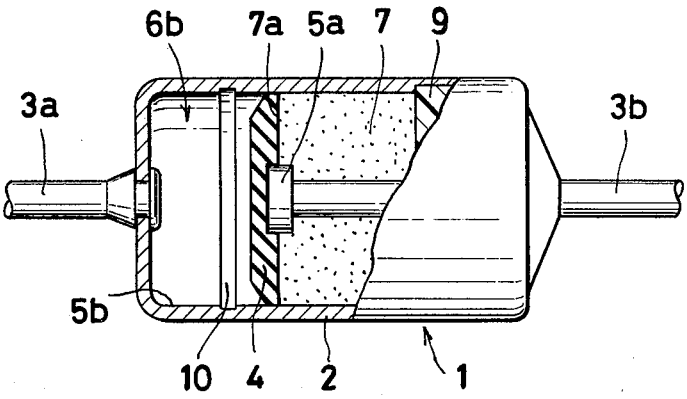
FIG. 4 is a sectioned view of a second embodiment of the thermal cut-off fuse according to the present invention.

In the embodiment set forth above, the contact means 4 is described as being formed of metal. If, however, in place of a metallic contact means, there is used a contact means made of a material having both electrical conductivity and elasticity such as conductive rubber, the bushing 8 can be eliminated. A modified arrangement employing electrically conductive rubber as the contact means 4 is shown in FIG. 4. Here the conductive rubber contact means 4 is positioned to maintain intimate contact with both the terminal face of terminal 5*a* and the surface 7*a* of the temperature-sensitive member 7 and is formed to the proper dimensions for maintaining appropriate pressure contact with the inner wall of the housing. This arrangement assures the electrical continuity is maintained between the leads 3*a* and 3*b* at normal temperature and that, since the temperature-sensitive member 7 is snugly fitted in the space 6*a*, the contact means 4 will be moved to the second position to break this electrical continuity when the ambience of the fuse rises to the melting point of the temperature-sensitive member to cause it to melt and undergo voluminal expansion.

In the case of the abovementioned two embodiments, impacts such as external vibrations which are exerted upon the thermal cut-off fuse after the fuse has fulfilled its function of breaking the continued electric path may possibly shake the contact means and bring it into accidental contact with the terminal portion 5*a* which has been separated from the contact means. To preclude such an accident, the thermal cut-off fuse of this invention is provided in the second position of the contact means shown in FIG. 3 or FIG. 4 with a groove 10 formed in the inner wall 5*b* of the housing, so that after the contact means 4 has been moved to this point, the petal-like peripheral portions 4*b* (or the periphery of the electrically conductive rubber) of the contact means 4 are allowed, by virtue of their resiliency, to snap into fast engagement with the groove and check the otherwise possible return of the contact means.

When the thermal cut-off fuse is provided with such a check member as described above, a coiled spring or other similar means may be contained in the space on the side of the second position of the contact means to keep the contact means 4, under the normal conditions, pressed toward the first position and, with the force of this pressure, allow the contact means in a form devoid of the perforation 4*a* to be kept in tight contact with the end face of the terminal 5*a* of the lead wire so as to establish required electric continuity of the terminals under normal conditions. In this arrangement, when the temperature-sensitive member is melted at the prescribed temperature and the force of the voluminal expansion of the molten member overcomes the force of the spring coil and moves the contact means to the second position illustrated in FIG. 3, the contact means which has been consequently brought into fast engagement with the groove 10 cannot return to its original position despite the resiliency of the spring coil.

Figure 5:
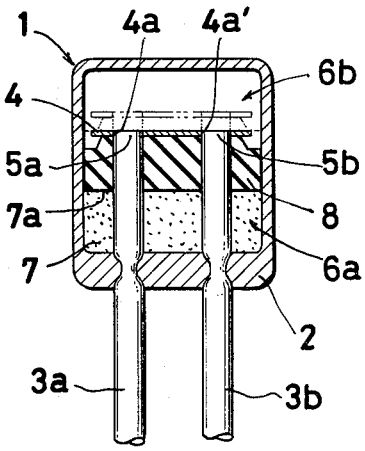
FIG. 5 is a sectioned view of the third embodiment of the thermal cut-off fuse according to the present invention.

The present invention can be effectively applied not merely to the thermal cut-off fuse of the axial type as described above but also to the thermal cut-off fuse of the vertical or radial type having a pair of lead wires extended from the housing in one same direction. One example of this type of thermal cut-off fuse will be described with reference to FIG. 5. The component parts of this thermal cut-off fuse which are identical or similar to those of the type described above are denoted by the same numerical symbols as used in the preceding embodiment.

The housing 2 in the present embodiment may be molded of an electrically nonconductive resin. The two lead wires 3*a*, 3*b* extend out of the housing in one same direction and they possess leading ends 5*a*, 5*b* which are both inserted in the hollow space of the housing. These leading ends serve as their respective terminal portions. The contact means 4 possesses perforations 4*a*, 4*a'* adapted to permit pressed insertion of the aforementioned terminal portions 5*a*, 5*b* respectively. The position indicated by the solid line in the drawing wherein the two perforations contain the two terminals is the first position for establishing electric continuity between the two lead wires.

The space 6*a* on the side of the first position of the contact means 4 is similarly filled with a temperature-sensitive member 7 and sealed tightly. Although the member is tightly sealed in this space, it is pressed down by the bushing 8 which is slidably set in position within the housing. When the member 7 is melted and is voluminally expanded at the prescribed temperature, it applies pressure to the bushing 8 and eventually causes the contact means 4 which abuts the opposite surface of the bushing to be pushed in the direction of the second position (indicated by the chain line in the drawing). Consequently, the two terminals 5*a*, 5*b* are released from their pressed insertion or contact with the contact means to effect required breakage of the electric continuity.

In this case, the contact means 4 is adapted so that it will separate simultaneously from the terminals 5*a*, 5*b* of the two lead wires. Optionally, one of the lead wires may be caulkingly attached to the housing 2 made of an electrically conductive material so that the inner wall of the housing will serve as the terminal portion of that lead wire and the contact means 4 may be adapted so that its periphery will remain in contact with the inner wall of the housing and its central portion will come into contact with the terminal of the other lead wire similarly to the construction of the first or second embodiment. When the contact means is made of electrically conductive rubber so as to enjoy freedom of sliding motion on the inner wall of the housing and, at the same time, provide tight seal to the member, then the bushing 8 may be eliminated and the contact means 4 may be directly opposed to or held in intimate contact with the open surface of the member. Also in the case of the embodiment illustrated in FIG. 5, the cross section of the housing may be circular or rectangular.

In any event, the present invention offers a thermal cut-off fuse using the smallest possible number of component parts and directly utilizes the property of a temperature-sensitive member for the effective operation of the thermal cut-off fuse. Thus, it can provide a highly reliable thermal cut-off fuse which is free from the failures ascribable to mechanical complication. The temperature at which the electric continuity is broken may be determined by suitably selecting the temperature-sensitive member to be used.

The coefficient of voluminal expansion of the member can, if desired, be easily achieved by incorporation of a suitable foaming agent and, optionally, an agent capable of promoting the action of the foaming agent as will be clear to any person of ordinary skill in the art. The expression "lead wires" is used in the present invention so comprehensively as to embrace additionally those in the form of terminals.

What is claimed is:

1. A thermal cut-off fuse for breaking electric continuity between first and second lead wires at a prescribed temperature, which comprises a housing, an electrically conductive contact means contained movably within the hollow space of said housing from the first to the second position, allowed while at the said first position to remain in contact with first and second terminal portions electrically connected within said housing respectively with said first and second lead wires and, while at the second position, to be separated from at least one of the two terminal portions, and a temperature-sensitive member sealed in a space within the housing on the side of the first position of said contact means, with the surface of said member opposed to the contact means, said member being adapted to remain solid under normal conditions and at the prescribed temperature being adapted to melt and undergo voluminal expansion, whereby the melting and voluminal expansion of the temperature-sensitive member at said prescribed temperature causes said surface of the member opposed to the contact means to be moved toward the contact means until the contact means is brought to the second position and the electric continuity between the first and second lead wires is broken.

2. The thermal cut-off fuse according to claim 1, wherein the contact means and the surface of the temperature-sensitive member opposed to said contact means interpose therebetween an electric bushing capable of sealing the inner wall of the housing and producing a sliding motion on the inner wall.

3. The thermal cut-off fuse according to claim 1, wherein the contact means is made of electrically conductive rubber capable of sealing the inner wall of the housing and the surface of the temperature-sensitive member opposed to the contact means is held in direct contact with the contact means.

4. The thermal cut-off fuse according to any of claims 1 to 3, wherein the first terminal portion within the housing of the first lead wire is the leading end of the first wire inserted in the hollow space of the housing and the second terminal portion within the housing of the second lead wire is the inner wall of the housing formed by fastening said second wire caulkingly to the housing made of an electrically conductive material.

5. The thermal cut-off fuse according to any of claims 1 to 3, wherein the first and second terminal portions connected respectively to the first and second lead wires are the leading ends of the respective lead wires inserted into the housing.

* * * * *